US009795891B1

(12) United States Patent
Logan

(10) Patent No.: US 9,795,891 B1
(45) Date of Patent: Oct. 24, 2017

(54) APPARATUS FOR SOOTHING A CHILD

(71) Applicant: Cody Logan, Decatur, IN (US)

(72) Inventor: Cody Logan, Decatur, IN (US)

( * ) Notice: Subject to any disclaimer, the term of this patent is extended or adjusted under 35 U.S.C. 154(b) by 0 days.

(21) Appl. No.: 15/087,510

(22) Filed: Mar. 31, 2016

(51) Int. Cl.

| | |
|---|---|
| ***A47D 13/10*** | (2006.01) |
| ***A63G 31/02*** | (2006.01) |
| ***A63G 31/16*** | (2006.01) |
| *A63G 31/00* | (2006.01) |

(52) U.S. Cl.
CPC ..... *A63G 31/02* (2013.01); *A63G 31/16* (2013.01)

(58) Field of Classification Search
CPC . A63G 1/00; A63G 1/34; A63G 21/00; A63G 21/08; A63G 27/02; A63B 2071/025; A63B 22/02; G09B 9/00; G09B 9/04; G09B 9/05; G09B 9/042; A47D 13/00; A47D 13/10
USPC ..... 472/36, 37, 43, 28, 35; 482/66; 434/62, 434/67; 73/1.37, 1.79, 1.84; 297/250.1, 297/256.16
See application file for complete search history.

(56) References Cited

U.S. PATENT DOCUMENTS

| | | | | |
|---|---|---|---|---|
| 4,214,381 A * | 7/1980 | Clark | G09B 9/04 | 434/67 |
| 5,346,398 A * | 9/1994 | Nakahata | G09B 9/05 | 273/442 |
| 5,464,381 A | 11/1995 | Wilson | | |
| 5,660,597 A | 8/1997 | Fox et al. | | |
| 5,711,045 A | 1/1998 | Caster et al. | | |
| 6,869,368 B1 * | 3/2005 | Clarke | A63G 1/00 | 297/256.16 |
| 7,013,704 B2 * | 3/2006 | Kusters | G01M 17/0072 | 702/104 |
| 7,036,880 B1 * | 5/2006 | Goodman | A47D 13/10 | 297/250.1 |
| 7,418,752 B2 | 9/2008 | Kemm | | |
| 7,551,100 B1 | 6/2009 | Salley et al. | | |

(Continued)

FOREIGN PATENT DOCUMENTS

EP 0738995 A1 10/1996

OTHER PUBLICATIONS

Website: http://www.dailymail.co.uk/sciencetech/article-1389850/The-baby-chair-drives-little-ones-land-Nod--meaning-theres-need-anymore-wheel.html Downloaded Jul. 9, 2015 Rocked to Sleep—The seat mimics the movements and sounds of a car.

(Continued)

*Primary Examiner* — Kien Nguyen
(74) *Attorney, Agent, or Firm* — Russ Weinzimmer & Associates, PC

(57) ABSTRACT

An apparatus for soothing a child is disclosed. The apparatus comprises a cart, a conveyor belt, and a stabilization frame. The cart is configured to receive and support a child seat, and includes a plurality of downwardly extending wheels. The conveyor belt is disposed below the cart to support the cart. The conveyor belt has an uneven surface. The wheels of the cart role over the uneven surface while the conveyor belt operates. The stabilization frame extends higher than the conveyor belt, surrounds the conveyor belt, and is configured to maintain the cart over the conveyor belt while the conveyor belt operates. Movements created by the wheels of the cart rolling over the uneven surface are transmitted via the cart to the child seat, which can have a soothing effect on a child seated therein.

18 Claims, 6 Drawing Sheets

(56) References Cited

U.S. PATENT DOCUMENTS

| | | | | |
|---|---|---|---|---|
| 7,703,848 | B1 | 4/2010 | Cochran et al. | |
| 7,717,798 | B2 | 5/2010 | Bellows et al. | |
| 7,770,971 | B2 | 8/2010 | Bellows et al. | |
| 7,814,587 | B2 | 10/2010 | Thomas | |
| 7,845,722 | B1 | 12/2010 | Manenti et al. | |
| 7,891,736 | B2 | 2/2011 | Sims, Jr. | |
| 7,918,505 | B2 | 4/2011 | Raphael et al. | |
| 8,047,609 | B2 | 11/2011 | Chen et al. | |
| 8,047,888 | B1 | 11/2011 | Seymore | |
| 8,225,651 | B2 * | 7/2012 | Scheepers | G01M 17/0072 73/116.01 |
| 8,690,245 | B2 | 4/2014 | Tuckey | |
| 8,777,764 | B2 | 7/2014 | Gregorian | |
| 8,820,834 | B2 | 9/2014 | Harding et al. | |
| 2002/0084682 | A1 | 7/2002 | Collins | |
| 2006/0057544 | A1 * | 3/2006 | Bond | G09B 9/042 434/62 |
| 2007/0040425 | A1 | 2/2007 | Miles et al. | |
| 2007/0214568 | A1 | 9/2007 | Dodder et al. | |
| 2010/0231014 | A1 | 9/2010 | Gibree et al. | |
| 2012/0248832 | A1 | 10/2012 | Boncher | |
| 2012/0299339 | A1 * | 11/2012 | Birch | A01M 31/02 297/188.01 |

OTHER PUBLICATIONS

Website: https://www.etsy.com/listing/122246257/vibrating-device-or-attachment-for-car?ref=related-0 Downloaded Jul. 9, 2015 WeWobbler—Vibrating Device or Attachment for Car Seats, Strollers, and Baby Carriers.

Website: https://forsalebyinventor.com/products/portfolio-item/child-seat-automobile-motionsimulator/ Downloaded Jul. 9, 2015 Child Seat Automobile Motion Simulator—Computerized apparatus that mimics the physical and audible effects of riding in a motor vehicle.

* cited by examiner

APPARATUS FOR SOOTHING A CHILD

FIELD

The present invention is directed to a child soothing apparatus and, more particularly, to an apparatus for vibrating a child seat to simulate a moving vehicle.

BACKGROUND

Some recognize that a child may be soothed using motion, such as a rocking motion. An individual may rock the child in their arms, in a rocking chair, in a rocking cradle, or the like. Automatic devices for rocking the child have also been developed. These include, for example, automatic swings.

A child is often soothed while riding in a child seat in a moving vehicle. The motion of the vehicle not only soothes the child but often lulls the child to sleep. However, it is very inconvenient for an individual, such as a parent, to drive the child around in the vehicle just for soothing the child. Accordingly, devices that hold the child while automatically simulating the motion of a vehicle have been developed. These devices, however, have several disadvantages. For example, the devices do not simulate the free range of motion associated with a ride in a vehicle. Further, they are often unsafe and expose various moving elements to the user, which can cause injury.

SUMMARY

One general aspect of the invention includes a cart configured to receive and support a child seat, the cart including a plurality of downwardly extending wheels. The cart also includes a conveyor belt disposed below the cart to support the cart, the conveyor belt having an uneven surface, the wheels of the cart rolling over the uneven surface while the conveyor belt operates. The cart also includes a stabilization frame, the stabilization frame extending higher than the conveyor belt, surrounding the conveyor belt, and being configured to maintain the cart over the conveyor belt while the conveyor belt operates. Movements created by the wheels of the cart rolling over the at least, one contour are transmitted via the cart to the child seat, which can have a soothing effect on a child seated therein.

Implementations of the invention may include embodiments having one or more of the following features. The apparatus where the conveyor belt includes a conveyor belt drive capable of driving the conveyor belt at a plurality of speeds. The apparatus where the uneven surface of the conveyor belt includes a contour extending across the conveyor belt to simulate a road bump. The apparatus where the conveyor belt includes a conveyor belt drive rigidly attached to the stabilization frame. The apparatus where the stabilization frame includes a plurality of elastic members, each elastic member being attached to both the stabilization frame and the cart. The apparatus where the cart includes at least one strap for securing the child seat to the cart. The apparatus where the cart includes an adjustment mechanism configured to accommodate a variety of child seat sizes. The apparatus where the cart includes an adjustment bar movable along the cart to accommodate a variety of child seat sizes. The apparatus where the plurality of downwardly extending wheels includes at least one swivel wheel. The apparatus where there are three downwardly extending wheels. The apparatus where there are three downwardly extending swivel wheels, a first swivel wheel supporting a front portion of the cart, and second and third swivel wheels together supporting a rear portion of the cart. The apparatus where the cart includes a plurality of safety flaps, each safety flap extending from a side of the cart to a side of the stabilization frame, thereby substantially blocking access to the underlying conveyor belt. The apparatus where the stabilization frame includes a plurality of elastic members, each elastic member being attached to both the stabilization frame and the cart to maintain the cart in position over the conveyor belt, while allowing the cart to be free to move in response to the wheels of the cart rolling over the at least one contour while the conveyor belt moves. The apparatus where the conveyor belt drive is adjustable to drive the conveyor belt at one of a plurality of speeds. The apparatus where the conveyor belt includes a contour extending across the conveyor belt to simulate a road bump moving under the wheels of the cart. The apparatus where the cart includes at least one strap for securing the child seat to the cart. The apparatus where the cart includes an adjustment mechanism configured to accommodate a variety of child seat sizes. The apparatus where the plurality of downwardly extending wheels includes at least one swivel wheel. The apparatus where the cart includes a plurality of safety flaps, each safety flap extending from a side of the cart to a side of the stabilization frame, thereby substantially blocking access to the underlying conveyor belt.

Another general aspect of the invention is directed to an apparatus for soothing a child that includes: a cart configured to receive and support a child seat, the cart including a plurality of downwardly extending wheels; and a conveyor belt assembly cooperative with the cart, the conveyor belt assembly including a conveyor belt having an uneven surface. The cart rests on the conveyor belt, and the wheels of the cart roll over the uneven surface while the conveyor belt moves. The apparatus also includes a stabilization frame, the stabilization frame extending higher than the conveyor belt, surrounding the conveyor belt, and being configured to maintain the cart in position over the conveyor belt, while allowing the cart to be free to move in response to the wheels of the cart rolling over the at least one contour while the conveyor belt moves. The apparatus also includes a conveyor belt drive capable of moving the conveyor belt, the conveyor belt drive being secured to the stabilization frame. Movements created by the wheels of the cart rolling over the at least one contour are transmitted via the cart to the child seat, which can have a soothing effect on a child seated therein.

Implementations of the invention may include one or more of the following features. The apparatus where the stabilization frame includes a plurality of elastic members, each elastic member being attached to both the stabilization frame and the cart to maintain the cart in position over the conveyor belt, while allowing the cart to be free to move in response to the wheels of the cart rolling over the at least one contour while the conveyor belt moves. The apparatus where the conveyor belt drive is adjustable to drive the conveyor belt at one of a plurality of speeds. The apparatus where the conveyor belt includes a contour extending across the conveyor belt to simulate a road bump moving under the wheels of the cart. The apparatus where the cart includes at least one strap for securing the child seat to the cart. The apparatus where the cart includes an adjustment mechanism configured to accommodate a variety of child seat sizes. The apparatus where the plurality of downwardly extending wheels includes at least one swivel wheel. The apparatus where the cart includes a plurality of safety flaps, each safety flap extending from a side of the cart to a side of the stabilization frame, thereby substantially blocking access to the underlying conveyor belt.

DETAILED DESCRIPTION

Figure 1:
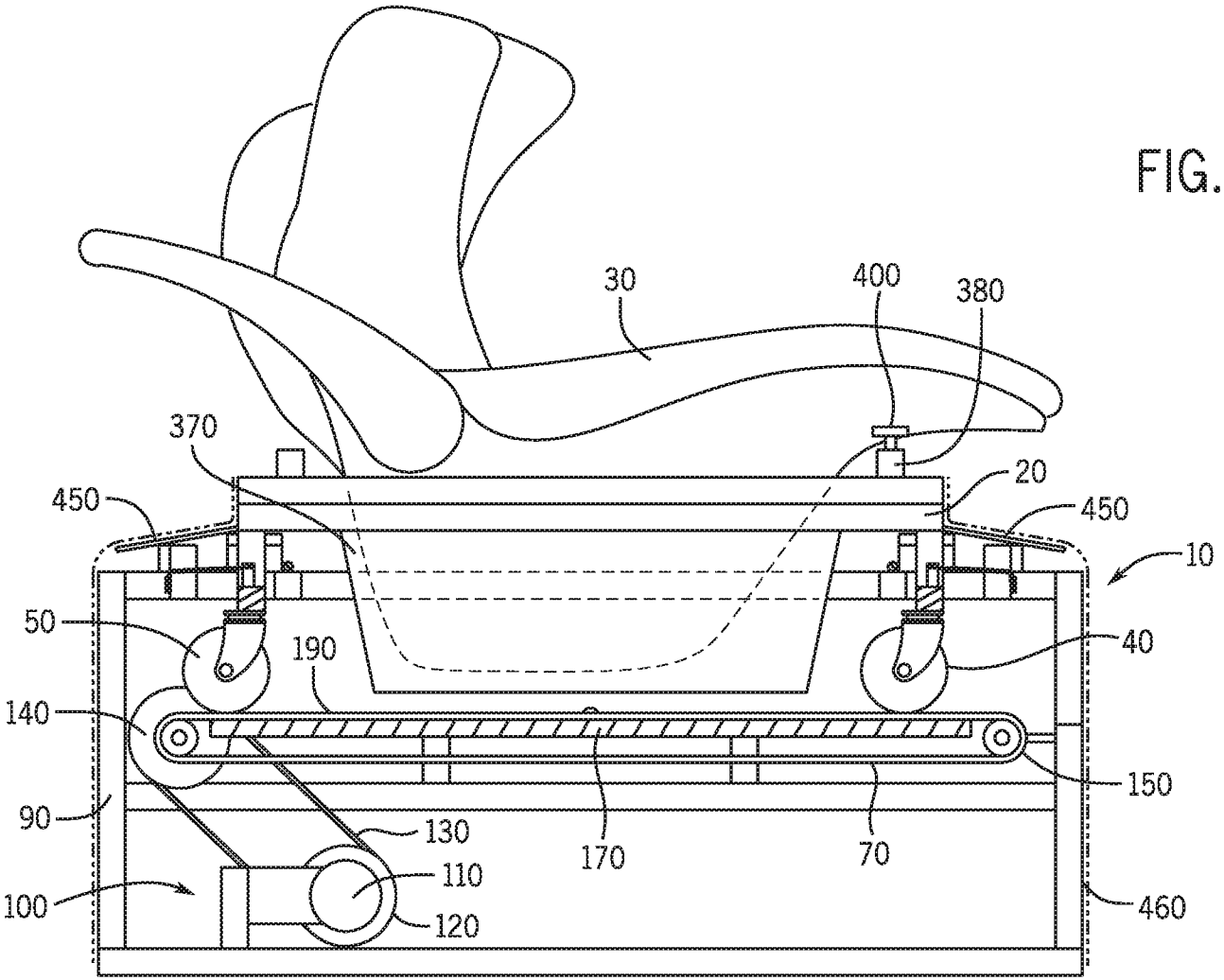
FIG. 1 is a side view of an apparatus for soothing a child, where outer surfaces have been removed to expose various structures of the apparatus.

FIG. 1 is a side view of an apparatus 10 for soothing a child, where outer surfaces have been removed to expose various interior structures. The apparatus 10 includes a cart 20 configured to receive and support a child seat 30. The cart 20 includes a plurality of downwardly extending wheels. Here, the downwardly extending wheels include a front wheel 40, a first rear wheel 50, and a second rear wheel 60. A conveyor belt 70 is disposed below the cart 20 to support the cart and is positioned so the wheels 40, 50, and 60 engage an outer surface of the conveyor belt 70 during operation.

The apparatus 10 also includes a stabilization frame 90 configured to maintain the cart 20 over the conveyor belt 70. As shown, the stabilization frame 90 extends higher than the conveyor belt 70, and is also configured to surround the conveyor belt 70.

The conveyor belt 70 is driven by a conveyor belt drive 100. The conveyor belt drive 100 includes a drive motor 110 in fixed alignment with the stabilization frame 90. The drive motor 110 may be rigidly attached directly to the stabilization frame 90 by welding, fasteners, etc. The drive motor 110 is configured for connection to a drive belt 130 which rotates a pulley assembly 140 disposed at a first end of the conveyor belt 70. A further pulley assembly 150 is disposed at a second end of the conveyor belt 70. As the drive motor 110 operates, the drive belt 130 rotates the pulley assembly 140 which drives the conveyor belt 70 and the further pulley assembly 150. The drive motor 110 may be capable of driving the conveyor belt 70 at a plurality of speeds. To this end, drive motor 110 may include a speed control interface 160 accessible to the user. The speed control interface 160 may be a digital interface, such as a digital input control connection to a servo-motor, and/or an analog interface, such as a rheostat controlling the voltage and/or current provided to the drive motor 110. Here, the speed control interface 160 includes a rheostat that is adjustable using a horizontal slide.

The conveyor belt 70 is supported by a platform 170, which may be directly or indirectly fixed to the stabilization frame 90. Here, a pair of opposed rigid frame members 180 are connected to the stabilization frame 90. The frame members 180 are connected to struts 185 extending between the frame members 180 and the platform 170.

Figure 6:
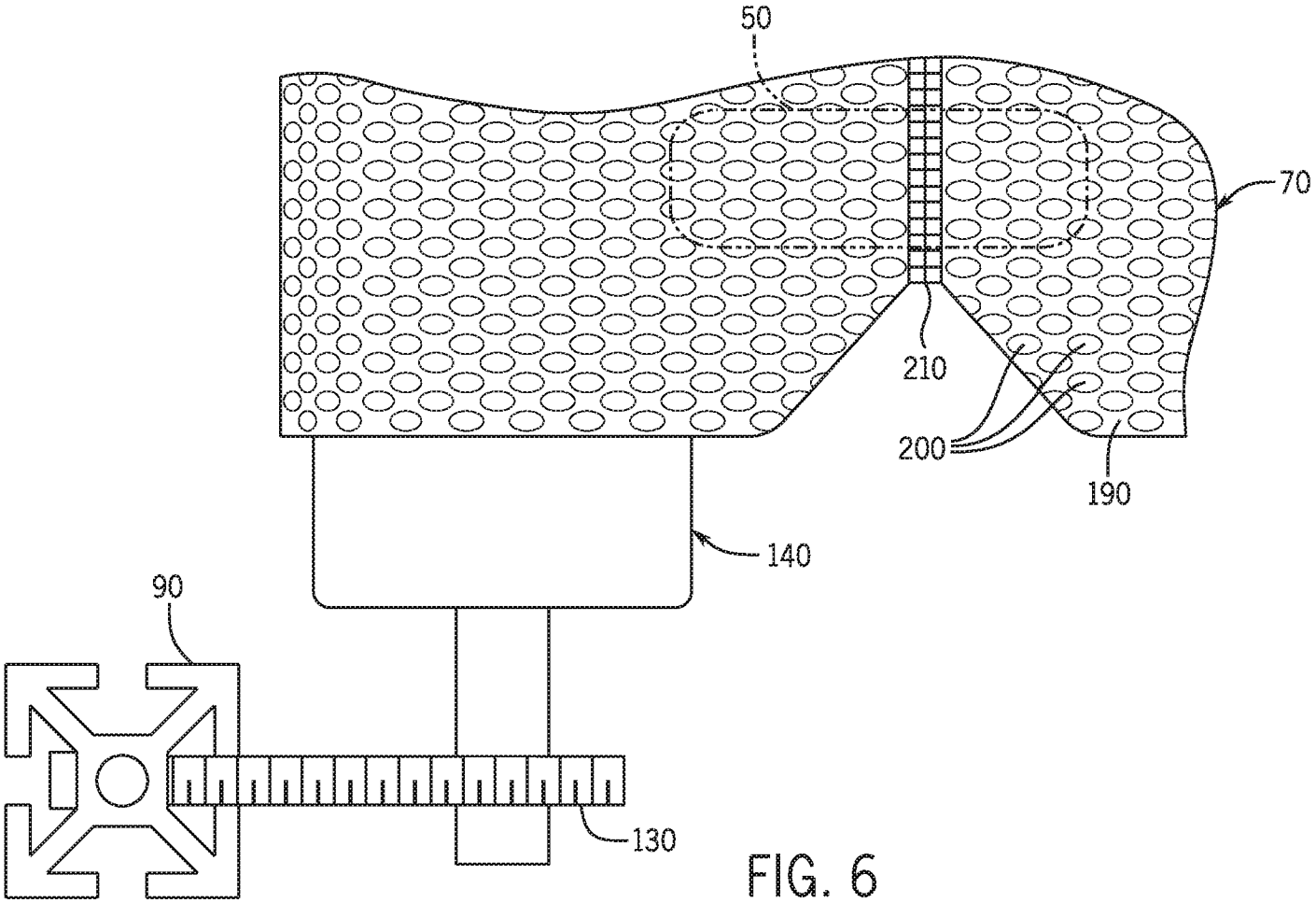
FIG. 6 is a cutaway view of one embodiment of a conveyor belt and corresponding conveyor belt drive.

As shown in FIG. 6, the conveyor belt 70 includes an uneven surface 190. Here, the uneven surface 190 may include a plurality of treads 200. The plurality of treads 200 may be spaced evenly, unevenly, or a combination of even and uneven areas to simulate the surfaces of a road, such as found on a paved surface. Additionally, or alternatively, the uneven surface 190 may include one or more contours 210 simulating a bump, such as a speed bump. In one example, the contour 210 may include a raised area formed where the end portions of the conveyor belt 70 are attached to one another. Other structures may be used to simulate the speed bump as well.

Figure 2:
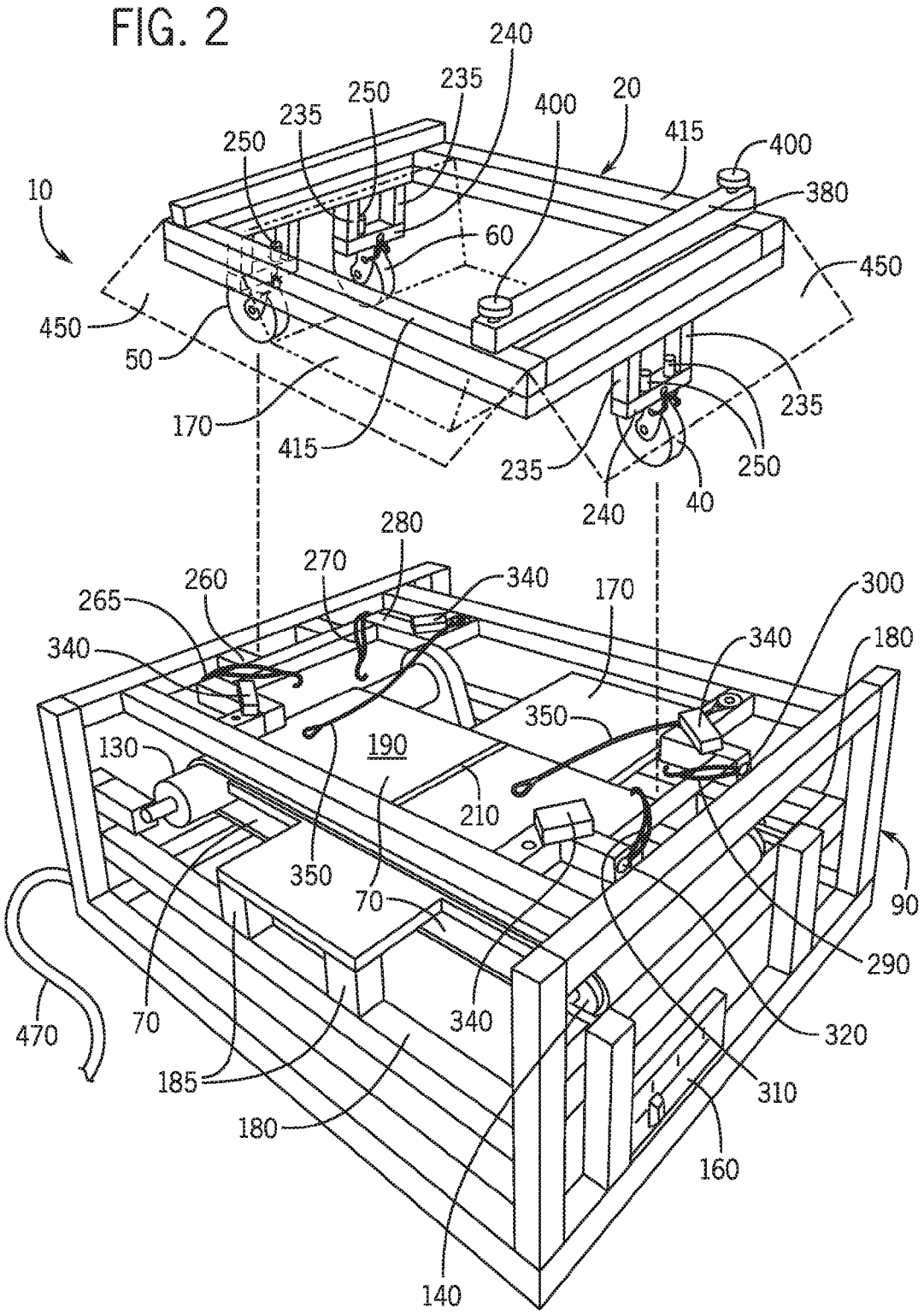
FIG. 2 is an exploded view of the apparatus showing the cart separated from the stabilization frame.

FIG. 2 is an exploded view of the apparatus 10 showing the cart 20 separated from the stabilization frame 90. In this embodiment, wheels 40, 50, and 60 in FIG. 2 are swivel wheels having respective swivel axes.

The wheels 40, 50, and 60 may be arranged on the cart 20 at various positions. In FIG. 2, the front wheel 40 is the only wheel attached to a front section of the cart 20 and is disposed proximate a midline of the cart 20. The first rear wheel 50 and second rear wheel 60 are attached to a rear section of the cart 20 on opposite sides of the midline of the cart 20.

Each wheel is attached to the cart 20 by respective struts 235, which, in turn, are connected with one another by respective crossbars 240. Each of the crossbars 240 may include an attachment peg 250. In this example, the crossbars 240 of wheels 50 and 60 each have an attachment peg 250 positioned inward of their respective swivel axes. The crossbar 240 of wheel 40 has a pair of attachment pegs 250 offset at opposite sides of its swivel axis.

Figure 5:
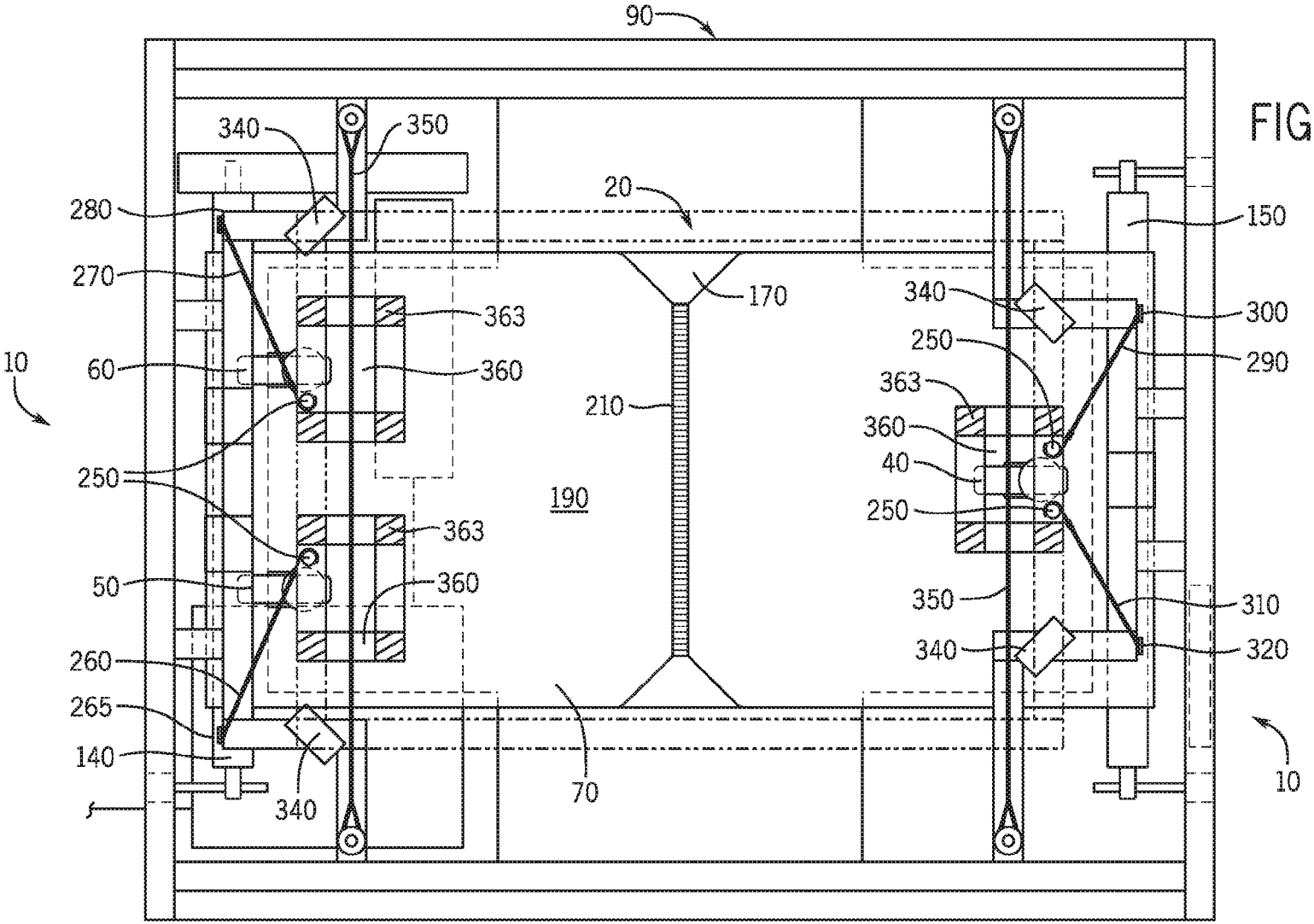
FIG. 5 is a top view of the apparatus for soothing a child showing the cart, conveyor belt, and stabilization frame.

Referring to both FIG. 2 and FIG. 5, apparatus 10 includes a plurality of elastic members extending between the stabilization frame 90 and the cart 20. In this embodiment, a first elastic member 260 extends between a first connection point 265 at a rear of the stabilization frame 90 and attachment peg 250 of crossbar 240. A second elastic member 270 extends between a second connection point 280 at the rear of the stabilization frame 90 and attachment peg 250 of crossbar 240. A third elastic member 290 extends between a third connection point 300 at a front of the stabilization frame 90 and attachment peg 250 of crossbar 240. A fourth elastic member 310 extends between a fourth connection point 320 at the front of the stabilization frame 90 and attachment peg 250 of crossbar 240.

During operation, the cart 20 and stabilization frame 90 are spaced from one another to allow the cart 20 to move within a defined boundary, but in a manner generally independent of the stabilization frame 90. Rather than having the cart 20 and stabilization frame 90 rigidly connected with one another, they are connected with the elastic members. The elastic members 260, 270, 290, and 310 provide a damping action as the cart 20 moves with respect to the stabilization frame 90.

Figure 3:
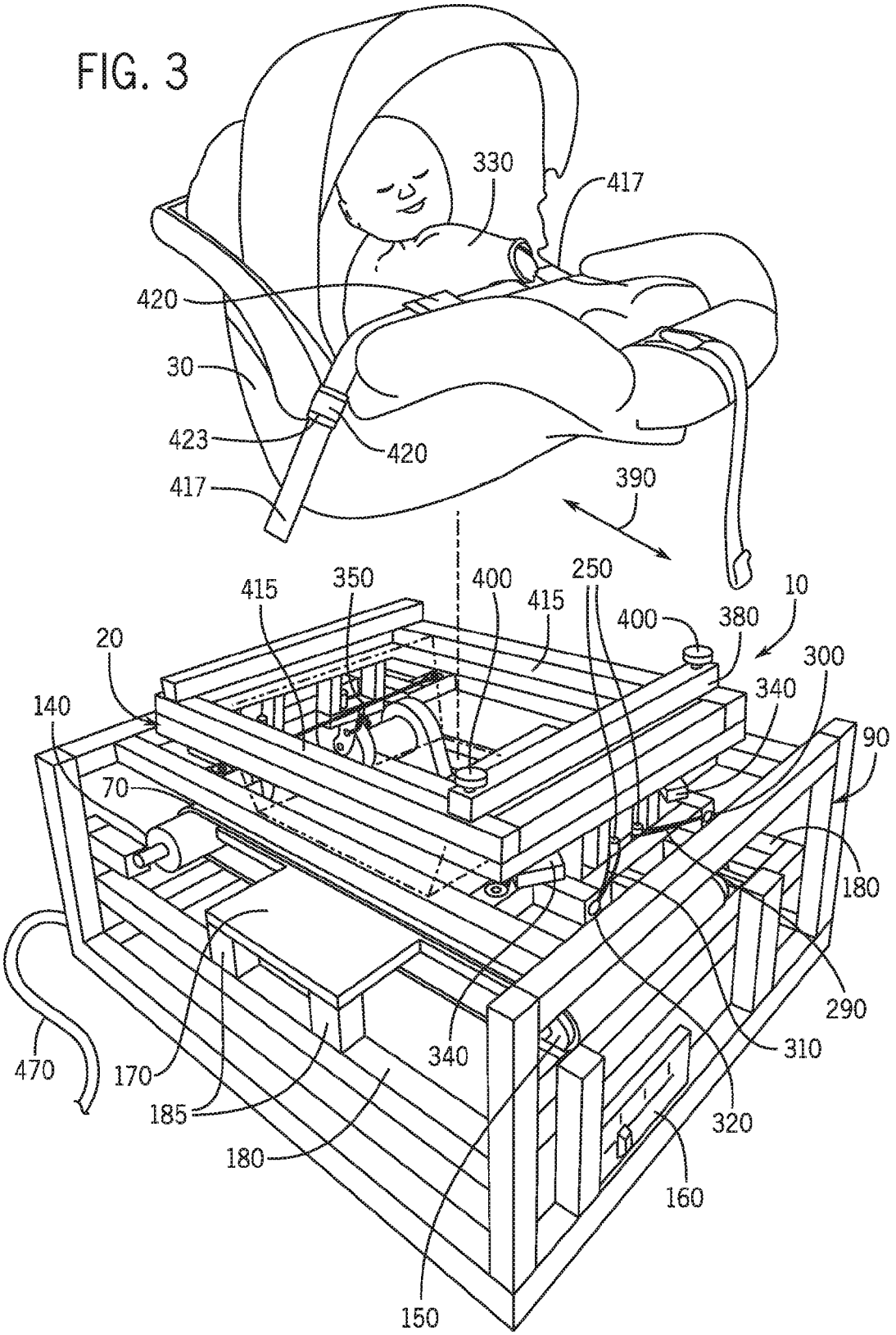
FIG. 3 is a perspective view of the apparatus for soothing a child where the outer surfaces have been removed to expose various structures of the apparatus.

In FIG. 3 and FIG. 5, the cart 20 is engaged with the stabilization frame 90. When engaged in this manner, the wheels 40, 50, and 60 support the cart 20 on the conveyor belt 70. Spacers 340 are disposed proximate corners of the stabilization frame 90 to keep the cart 20 properly positioned over the conveyor belt 70 if pressure is applied unevenly in a downward motion on one or more edges of the cart 20. However, during normal operation, the spacers 340 and cart 20 do not touch one another. Spacers 340 may be formed from a rigid material, a shock absorbing material, or a combination of both.

Once the cart 20 and stabilization frame 90 are engaged with one another, the elastic members 260, 270, 290, and 310 are attached to the respective attachment pegs 250. The user also attaches a pair of restraining cords 350 cross front and rear portions of the stabilization frame 90. At least one end of each restraining cord 350 may be detached from the stabilization frame 90. The restraining cords 350 may overlie wells 360 defined in extensions 363 of each wheel assembly. The cords 350 are shown in their detached state in FIG. 2 and in an attached state in FIG. 3 and FIG. 5. The pair of restraining cords 350 are spaced above the wells 360 and do not contact the cart 20 when attached. Therefore, they do not affect the movement of the cart 20 during normal operation.

Once the cords 350 are in the attached state shown in FIG. 3 and FIG. 5, they prevent the user from removing the cart 20 from the stabilization frame 90. Any attempt to lift the cart 20 from the stabilization frame 90 with the cords 350 attached causes the cords 350 to engage the wells 360 and prevents further lifting of the cart 20 from the stabilization frame 90. This arrangement assists in maintaining the integrity of the elastic members 260, 270, 290, and 310 and prevents their breakage in the event that the user attempts to remove the cart 20 without first removing the elastic members. In effect, the user is prompted to check that the elastic members and cords are detached before the cart 20 is lifted from the stabilization frame 90. In one manner of use, the user detaches the elastic members 260, 270, 290, and 310, from the cart 20 before detaching the cords 350 from their operating positions. Once the cords and elastic members are detached as shown in FIG. 2, the user may safely remove the cart 20 from the stabilization frame 90.

In FIG. 3 the child seat 30 is positioned over a pocket 370 of the cart 20. In this embodiment, the cart 20 includes an adjustment mechanism configured to accommodate many child seat sizes. Here, the adjustment mechanism includes an adjustment bar 380 that is movable along a length of the cart 20 in the directions shown by arrow 390. A pair of securements 400 are disposed at opposite ends of the adjustment bar 380. The securements 400 are loosened to allow the adjustment bar 380 to move along rails 415 to change the dimensions of the opening of pocket 370. The user adjusts the opening of pocket 370 to the dimension needed to accommodate the child seat 30. After moving the adjustment bar 380 to the desired position, securements 400 are tightened to fasten the adjustment bar 380 with rails 415. Once fastened, the adjustment bar 380 is maintained at the desired position to fit the child seat 30 in the pocket 370.

Figure 4:
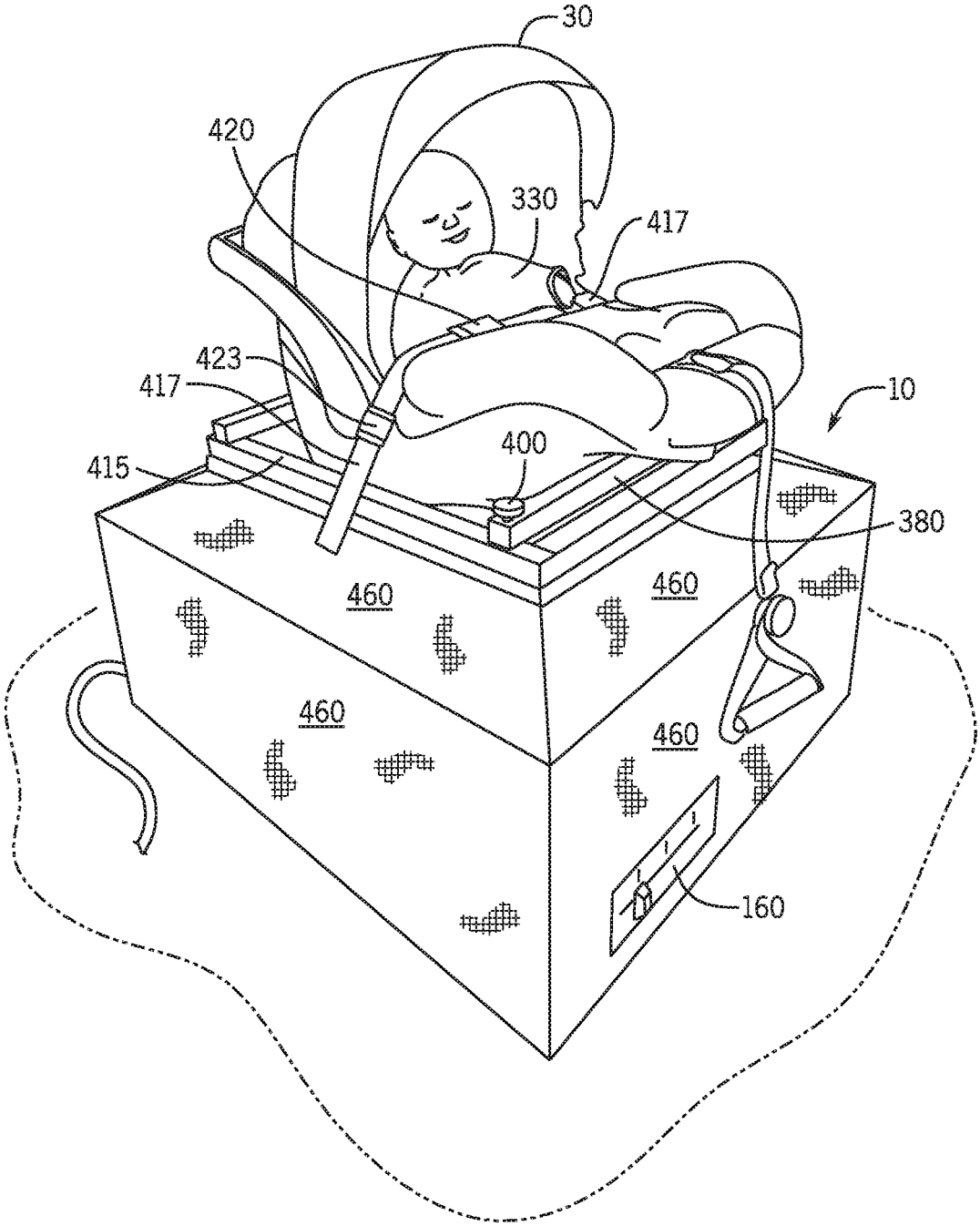
FIG. 4 is a perspective view of the apparatus for soothing a child in its operating state with the child seat in place.

FIG. 3 and FIG. 4 illustrate one manner of fixing the child seat 30 to the cart 20. In this embodiment, a pair of straps 417 are attached at opposite sides of the cart 20 (not shown in an attached state in FIG. 3). Once the child seat 30 is placed in the pocket 370, the straps 417 may be connected with one another at a buckle 420 to secure the child 330 and child seat 30 with the cart 20. The length of at least one of the straps 417 may be adjusted with an adjustment buckle 423.

As shown in FIG. 2 and FIG. 4, the cart 20 may be provided with various safety mechanisms. In this embodiment, the cart 20 includes a plurality of safety flaps 450 connected by respective hinges at each side of the cart 20. The safety flaps 450 may be rotatable between a first position (prior to engaging the cart 20 with the stabilization frame 90), and a second position (after engaging the cart 20 with the stabilization frame 90). In the first position, the safety flaps 450 extend from the sides of the cart 20 in a generally downward direction. Rotation of the safety flaps 450 to the second position causes each safety flap 450 to extend in a generally horizontal direction from a side of the cart 20 to a side of the stabilization frame 90. In this second position, the safety flaps 450 substantially block access to the underlying conveyor belt 70. The safety flaps 450 also may substantially block access to the conveyor belt drive 100.

FIG. 4 shows the apparatus 10 in its operation state. As shown, the adjustment bar 380 has been moved to a position on rails 415 so that the child seat 30 sits properly within pocket 370. The straps 417 are buckled with one another to secure the child 330 and the child seat 30 with the cart 20. One or more sheets of a durable fabric 460 may substantially surround the stabilization frame 90 and cover the outer portions of the safety flaps 450. The fabric 460 includes an opening through which the speed control interface 160 may be accessed. A cord 470 provides a connection between the apparatus 10 and shore power. As the conveyor belt 70 runs, movements created by the wheels of the cart as they travel over uneven surface 190 are transmitted, via the cart 20, to the child seat 30. Such movements typically have a soothing effect on the child 330 in the child seat 30.

In the preceding specification, specific embodiments have been described. However, it is understood that various modifications and changes can be made without departing from the scope of the claims set forth below. Accordingly, the specification and figures are to be regarded in an illustrative rather than a restrictive sense, and all such modifications are intended to be included within the scope of the present teachings.

The invention claimed is:

1. An apparatus for soothing a child, the apparatus comprising:

a cart configured to receive and support a child seat, the cart including a plurality of downwardly extending wheels;

a conveyor belt disposed below the cart to support the cart, the conveyor belt having an uneven surface, the wheels of the cart rolling over the uneven surface while the conveyor belt operates;

a stabilization frame, the stabilization frame extending higher than the conveyor belt, surrounding the conveyor belt, and being configured to maintain the cart over the conveyor belt while the conveyor belt operates, and a plurality of elastic members, each elastic member being attached to both the stabilization frame and the cart, movements created by the wheels of the cart rolling over the uneven surface being transmitted via the cart to the child seat, which can have a soothing effect on a child seated therein.

2. The apparatus of claim 1, wherein the conveyor belt includes a conveyor belt drive capable of driving the conveyor belt at a plurality of speeds.

3. The apparatus of claim 1, wherein the uneven surface of the conveyor belt includes a contour extending across the conveyor belt to simulate a road bump.

4. The apparatus of claim 1, wherein the conveyor belt includes a conveyor belt drive rigidly attached to the stabilization frame.

5. The apparatus of claim 1, wherein the cart includes at least one strap for securing the child seat to the cart.

6. The apparatus of claim 1, wherein the cart includes an adjustment mechanism configured to accommodate a variety of child seatsizes.

7. The apparatus of claim 1, wherein the cart includes an adjustment bar movable along the cart to accommodate a variety of child seatsizes.

8. The apparatus of claim 1, wherein the plurality of downwardly extending wheels includes at least one swivel wheel.

9. The apparatus of claim 1, wherein there are three downwardly extending wheels.

10. The apparatus of claim 1, wherein there are three downwardly extending swivel wheels, a first swivel wheel supporting a front portion of the cart, and second and third swivel wheels together supporting a rear portion of the cart.

11. The apparatus of claim 1, wherein the cart includes a plurality of safety flaps, each safety flap extending from a side of the cart to a side of the stabilization frame, thereby substantially blocking access to the underlying conveyor belt.

12. An apparatus for soothing a child, the apparatus comprising:

a cart configured to receive and support a child seat, the cart including a plurality of downwardly extending wheels; and a conveyor belt assembly cooperative with the cart, the conveyor belt assembly including:

a conveyor belt having at least one contour thereon, the cart resting upon the conveyor belt, and the wheels of the cart rolling over the at least one contour while the conveyor belt moves, a stabilization frame, the stabilization frame extending higher than the conveyor belt, surrounding the conveyor belt, and being configured to maintain the cart in position over the conveyor belt, while allowing the cart to be free to move in response to the wheels of the cart rolling over the at least one contour while the conveyor belt moves, the stabilization frame including a plurality of elastic members, each elastic member being attached to both the stabilization frame and the cart to maintain the cart in position over the conveyor belt, while allowing the cart to be free to move in response to the wheels of the cart rolling over the at least one contour while the conveyor belt moves, and a conveyor belt drive capable of moving the conveyor belt, the conveyor belt drive being secured to the stabilization frame, movements created by the wheels of the cart rolling over the at least one contour being transmitted via the cart to the child seat, which can have a soothing effect on a child seated therein.

13. The apparatus of claim 12, wherein the conveyor belt drive is adjustable to drive the conveyor belt at one of a plurality of speeds.

14. The apparatus of claim 12, wherein the conveyor belt includes a contour extending across the conveyor belt to simulate a road bump moving under the wheels of the cart.

15. The apparatus of claim 12, wherein the cart includes at least one strap for securing the child seat to the cart.

16. The apparatus of claim 12, wherein the cart includes an adjustment mechanism configured to accommodate a variety of child seatsizes.

17. The apparatus of claim 12, wherein the plurality of downwardly extending wheels includes at least one swivel wheel.

18. The apparatus of claim 12, wherein the cart includes a plurality of safety flaps, each safety flap extending from a side of the cart to a side of the stabilization frame, thereby substantially blocking access to the underlying conveyor belt.

* * * * *